US005119796A

United States Patent [19]

Dehlbom

[11] Patent Number: 5,119,796

[45] Date of Patent: Jun. 9, 1992

[54] ARCHERY BOW RISER WITH SIDE-ANGLED HANDGRIP

[76] Inventor: Michael L. Dehlbom, Rte.1, Box 1635, Kenai, Ak. 99611

[21] Appl. No.: 593,937

[22] Filed: Oct. 3, 1990

[51] Int. Cl.[5] ..... F41B 5/00

[52] U.S. Cl. ..... 124/23.1; 124/88

[58] Field of Search ..... 124/23.1, 24.1, 25, 124/25.6, 88, 89

[56] References Cited

U.S. PATENT DOCUMENTS

| | | | |
|---|---|---|---|
| 87,344 | 3/1869 | Judd | 124/24.1 |
| 213,851 | 4/1879 | Streeter | 124/23.1 |
| 218,079 | 7/1879 | Streeter | 124/24.1 |
| 2,842,113 | 7/1958 | Roper | 124/24 |
| 2,960,084 | 11/1960 | Kramer | 124/24 |
| 3,129,525 | 4/1964 | Lewis | 124/24.1 X |
| 3,171,397 | 3/1965 | Daly | 124/88 X |
| 3,207,146 | 9/1965 | Grable | 124/24 |
| 3,527,195 | 9/1970 | Corio | 124/23 |
| 3,757,762 | 9/1973 | Cousin | 124/24 |
| 3,834,368 | 9/1974 | Geiger | 124/88 X |
| 4,041,925 | 8/1977 | Barrick | 124/35 |
| 4,644,929 | 2/1987 | Peck | 124/24 |
| 4,662,344 | 5/1987 | Mitchell | 124/24.1 X |
| 4,787,361 | 11/1988 | Vyprachticky | 124/88 |
| 4,957,093 | 9/1990 | Hamlett | 124/88 X |
| 4,976,250 | 12/1990 | Jeffrey | 124/88 X |

*Primary Examiner*—Peter M. Cuomo
*Assistant Examiner*—Jeffrey L. Thompson
*Attorney, Agent, or Firm*—Christensen, O'Connor, Johnson & Kindness

[57] ABSTRACT

The present invention provides a bow riser (handle) having substantially colinear upper and lower sections, and a handgrip integrated therebetween at an angle with respect to one side of the lower section. The riser is intended to be used in a vertically held archery bow formed by integrating bow limbs with the upper and lower sections of the riser and fixing a bowstring therebetween. As seen by a right-handed archer, the handgrip is oriented at an angle away from the left side of the lower section, such that the archer's left hand is rotated somewhat clockwise. For a right-handed archer, the handgrip is angled from the left side of the riser. The orientation of the handgrip provides greater clearance between the forearm of the archer and the bowstring than that obtained with conventional bow risers in which the handgrip is positioned along the longitudinal axis of the riser.

18 Claims, 2 Drawing Sheets

ARCHERY BOW RISER WITH SIDE-ANGLED HANDGRIP

TECHNICAL AREA OF THE INVENTION

The present invention relates to archery bows, and, in particular, to risers (handles) for vertically held archery bows.

BACKGROUND OF THE INVENTION

An archer generally shoots an archery bow from a sideways stance with the archery bow held substantially vertically. The central section of an archery bow is a riser that includes a handgrip. With a conventional bow, the handgrip is substantially colinear with the longitudinal axis of the riser such that the archer's hand is substantially vertical when grasping the bow for shooting, i.e., the archer's grasping hand encloses a portion of the longitudinal axis.

With such a conventional bow, there is frequently insufficient clearance between the archer's forearm and the bowstring. This lack of clearance causes the bowstring to strike or brush the archer's forearm as the bowstring returns to its rest position after a shot. If the bowstring strikes or brushes the archer's forearm, the arrow and bowstring are deflected sideways as the bowstring is accelerating the arrow. Such deflection significantly affects the flight of the arrow, reducing the accuracy and precision with which the arrow can be shot. In addition, a bowstring striking the forearm of an archer is painful for the archer. Insufficient bowstring/forearm clearance is particularly pronounced for archers with large forearms and archers who hyper-extend their elbows. Bulky clothing, e.g., a jacket, further aggravates this problem.

Some archers take measures to reduce the effect of or to alleviate the bowstring/forearm clearance problem. However, the measures taken are generally not completely satisfactory. An archer may hold a bow with an arm that is somewhat bent so that the clearance between the bowstring and the forearm is increased; this form of shooting is both unstable and uncomfortable. Alternatively, an archer may hold a bow canted such that the top of the bow is tilted away from the archer's front side. While this form of shooting increases the clearance between the bowstring and the archer's forearm, the form forces the archer to roll his back and tilt his head forward so that he can aim the arrow, which is also an unstable and uncomfortable position for shooting. To reduce the pain of the bowstring striking the forearm, some archers wear a forearm guard. While forearm guards reduce pain by preventing the bowstring from striking the forearm directly, the bowstring may be deflected by the forearm guard so that accuracy and precision are still decreased.

The risers of conventional bows are generally designed with vertical handgrips that allow the archer to hold the bow with a line of force passing through the wrist, elbow, and shoulder of the archer's arm holding the bow. Alignment of the line of force in this manner along the archer's arm produces a comfortable and stable shooting position. However, when an archer modifies his form to increase the bowstring/forearm clearance, this alignment can be sacrificed. For example, if an archer bends his arm to increase the bowstring-/forearm clearance, the line of force no longer passes through his elbow. As a result, torques are developed that create strain in the archer's arm.

Recently, archery bows that are designed to be held substantially horizontal have been introduced. These bows are similar in design to crossbows. In a bow of this type, a handgrip is formed generally orthogonal to the plane of the bow, which is defined by the plane including the limbs of the bow and the bowstring; the plane of the bow is substantially horizontal when the bow is held for shooting. The bow is designed with a sight window positioned on the side of the bow opposite the handgrip, i.e., the handgrip and sight window are formed on opposite sides of the plane of the bow. An arrow positioned for shooting rests in the sight window. The orientation of the sight window and handgrip allows the arrow and the bowstring to lie and pass above the arm of an archer that holds the bow substantially horizontally.

SUMMARY OF THE INVENTION

The present invention provides a riser for use in a vertically held archery bow. The riser of the present invention comprises upper and lower sections, and a handgrip integrated between the upper and lower sections. The upper and lower sections are substantially colinear with the longitudinal axis of the riser; the handgrip is angled to one side of the riser. When a right-handed archer grasps the handgrip with his left hand, the handgrip is oriented at an angle between 0° and 180° clockwise from the left side of the riser lower section as seen by such an archer. Thus, the archer's left hand is rotated clockwise from the longitudinal axis of the bow riser. An opposite orientation is achieved by a left-handed riser. The handgrip orientation provides the archer with greater clearance between the shooting forearm and the bowstring than that obtained with conventional bow risers in which the handgrip is formed colinearly with the longitudinal axis of the riser. The handgrip also allows the archer to hold the bow with a line of force generally passing through the wrist, elbow, and shoulder of the archer's arm, which is a stable and comfortable shooting position.

In accordance with further aspects of the present invention, the handgrip is oriented between 20° and 100° from a side of the riser lower section.

In accordance with other aspects of the present invention, the central axis of the handgrip lies in a plane relative to the bow plane, which is formed by the bow. The plane in which the handgrip lies is generally orthogonal to the bow plane and vertical when the bow is held for shooting.

In accordance with further aspects of the present invention, the riser includes a connecting section. One end of the handgrip is integrated with the upper section and the other end of the handgrip is integrated with the lower section by the connecting section. The handgrip and connecting section are angled to the left side of the upper and lower sections for a right-handed archer, as seen thereby. The handgrip and connecting section together generally form a "C" shape. For a left-handed archer, the handgrip is angled away from the right side of the riser lower section.

In accordance with other aspects of the present invention, the upper section of the bow riser is formed with an arrow support element on the same side of the riser from which the handgrip is angled. The arrow support element supports the shaft of an arrow when positioned for shooting. The arrow support element may be formed with a recess in the upper section of the riser. The recess allows the archer to view the target without interference from the riser.

The riser of the present invention can be used as the central section of all major types of archery bows including longbows, recurve bows, and compound bows. The increased bowstring/forearm clearance in a bow incorporating the present riser greatly decreases the likelihood of the bowstring striking or brushing the forearm of an archer. Thus, archery bows incorporating the riser of the present invention allow arrows to be shot with greater accuracy and precision.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein.

DETAILED DESCRIPTION OF THE PREFERRED EMBODIMENT

Figure 1:
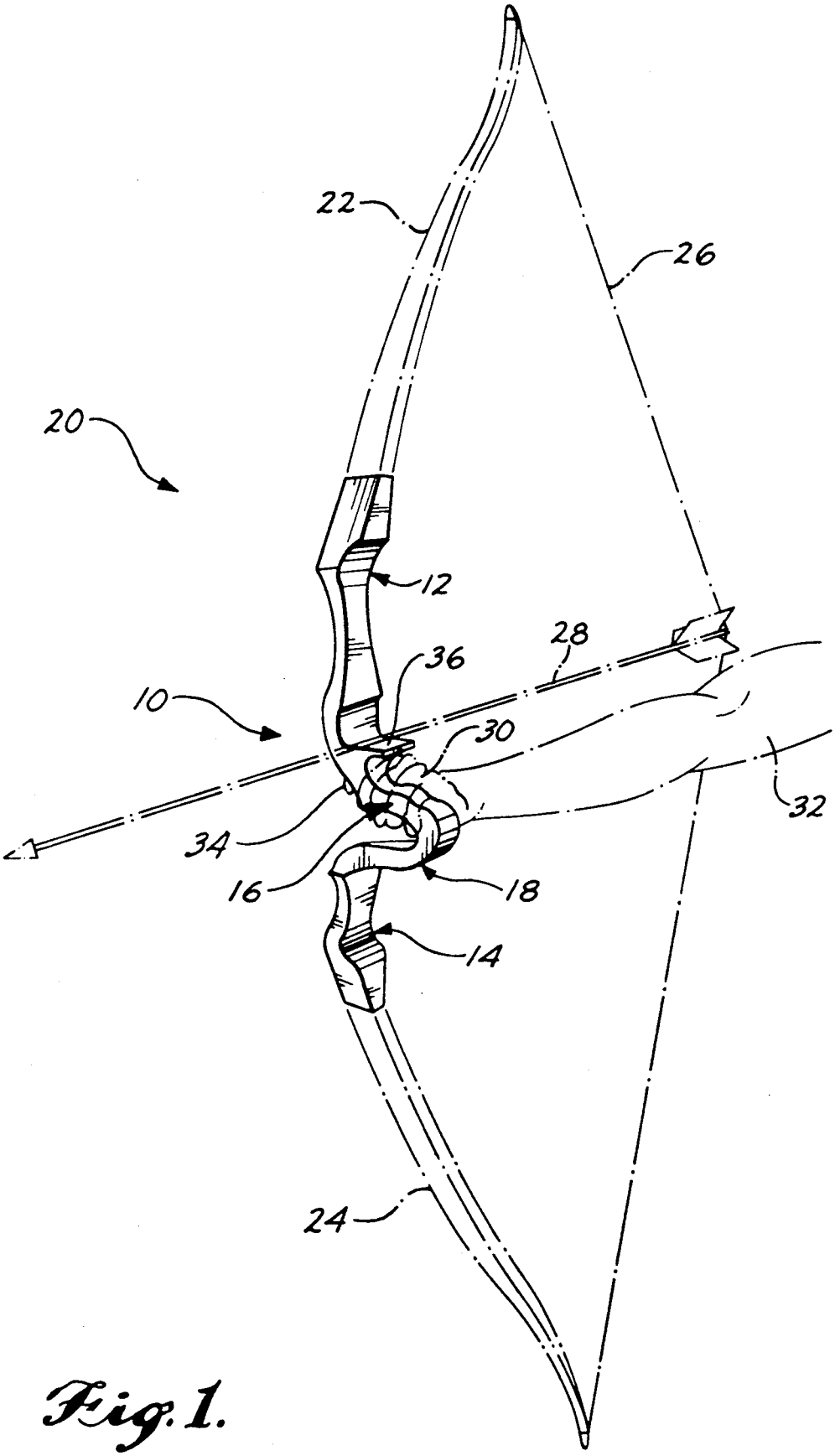
FIG. 1 is a perspective view of a right-handed archery bow including a bow riser formed in accordance with the present invention.

With reference to FIG. 1, a bow riser 10 formed in accordance with the present invention comprises an upper section 12, a lower section 14, a handgrip 16, and a connecting section 18. The various sections of the riser can also be seen in FIG. 2, which includes horizontal dashed lines delineating the aforementioned sections. The handgrip 16 and the connecting section 18 are integrated between the upper and lower sections such that the handgrip is angled to one side of the riser 10.

As shown in FIG. 1, the riser 10 of the present invention is intended to be used in a vertically held archery bow 20, the non-riser portions of which are shown in reference. The archery bow 20 includes an upper bow limb 22 attached to the upper section 12, and a lower limb 24 attached to the lower section 14 of the riser. A bowstring 26 is strung taut between the far ends of the upper and lower limbs. The riser, bow limbs, and bowstring form the plane of the bow, which is generally vertical when the bow is held for shooting. An archery arrow 28, shown in reference, is positioned for shooting, and an archer's hand 30, shown in reference, is depicted grasping the handgrip 16. The archer's hand 30 is generally horizontal, i.e., the palm of the hand 30 is facing downward.

The riser 10 is formed for a right-handed archer. The right-handed archer holds the bow 20 with his left arm 32 extended. As seen by the archer, the handgrip 16 and connecting section 18 are angled from the left side of the riser. The orientation of the handgrip 16 forces the archer to rotate his left hand 30 clockwise so that the palm of his hand faces downward; the handgrip orientation provides the archer with greater bowstring forearm clearance than that in conventional risers. The archer's fingers wrap around the front portion of the handgrip. The archer's thumb 34 wraps around the end of the handgrip that curves upward into the upper section; the thumb 34 is not generally bent upwardly or downwardly.

Figure 2:
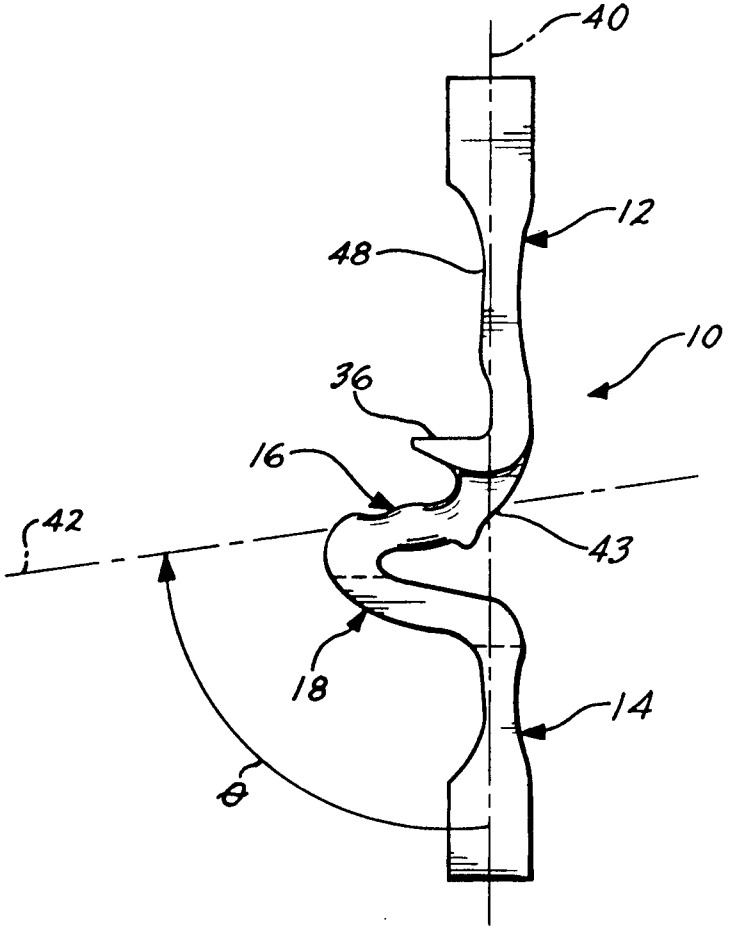
FIG. 2 is a rear view, as seen by an archer, of the bow riser shown in FIG. 1.

The orientation of the archer's thumb 34 on the handgrip relative to the remainder of the hand reduces the magnitude of torques that would otherwise tend to twist the riser about its longitudinal axis 40, which is shown in FIG. 2. In essence, the archer braces the riser with a line of force passing through the wrist, elbow and shoulder of the archer's left arm 32. The archer's arm 32 is subjected to very little torque when an arrow is drawn, aimed and released. The minimization of torques on the archer's arm is important, because large torques on the archer's arm tend to cause the riser to move and rotate as the arrow is released and thus deflect the arrow, and as a result reduce the accuracy and precision with which arrows are shot.

With reference again to FIG. 2, the upper 12 and lower 14 sections are substantially colinear with the longitudinal axis 40, which generally lies in the plane of the bow. The handgrip 16 and connecting section 18 both extend away from the left side of the riser and together generally form a "C" shape. The handgrip 16 has a generally straight midsection that is colinear with a central axis 42. The handgrip 16 is oriented at an angle $\theta$ from the left side of the lower section 14, i.e., the angle $\theta$ is measured from the longitudinal axis 40 to the central axis 42. The angle $\theta$ is preferably between 20° and 100°. In the embodiment shown in the figures the angle $\theta$ is approximately 80°. However, the handgrip 16 can be formed at any non-zero angle $\theta$ between 0° and 180° from the lower section 14. The smaller the angle $\theta$, the less the hand 30 of the archer is rotated clockwise and the smaller the increase in bowstring/forearm clearance. The bowstring/forearm clearance is greatest when the angle $\theta$ is approximately 90°.

In one preferred embodiment, the central axis 42 lies in a plane; the plane is generally orthogonal to the bow plane and vertical when the bow is held for shooting. Thus, the handle extends generally straight sideways from the bow when it is held for shooting. However, the handle may also be canted forward or rearward to accommodate other riser design characteristics.

When the arrow 28 is positioned for shooting, the shaft of the arrow rests on an arrow shelf 36 formed in the upper section 12 above the handgrip. The arrow shelf 36 comprises a substantially horizontal platform extending from the left side of the riser, which is the same side of the riser from which the handgrip 30 is angled; thus, the arrow 28, when positioned for shooting, lies on the same side of the riser away from which the handgrip is angled. The orientation of the arrow shelf and handgrip forces the archer to hold the bow 20 substantially vertically when shooting arrows. The archer cannot hold the bow substantially horizontally because the archer's left arm 32 would obstruct the arrow 28 and the bowstring 26.

The upper section 12 is formed with a recess 48 parallel with the longitudinal axis 40. The recess 48 begins just above the handgrip and extends upward a substantial length of the upper section 12. The recess is formed on the left side of the riser, i.e., on the same side of the riser from which the handgrip is angled. The arrow shelf 36 is formed by the bottom of the recess 48 nearest the handgrip; the arrow shelf 36 is substantially orthogonal to the longitudinal axis 40. In addition to forming an arrow shelf for an arrow to rest on, the recess 48 allows an archer to aim at a target by sighting along the shaft of the arrow; without the recess 48, the archer's view would be blocked. In an alternative arrow support arrangement, an arrow support eyelet is attached to the upper section and extends into the recess. The arrow is positioned for shooting by resting it on the eyelet.

Figure 3:
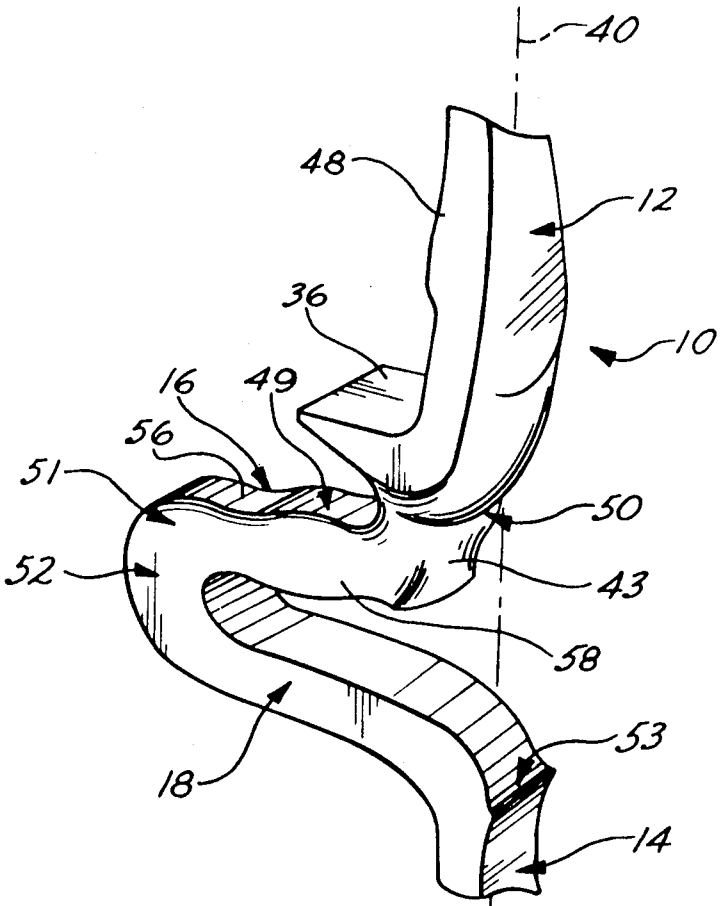
FIG. 3 is a right-rear perspective view of the middle section of the bow riser shown in FIG. 1 that includes the handgrip of the riser.

FIG. 3 provides a detailed view of the handgrip 16, the connecting section 18, and the arrow shelf 36, and will be briefly described so that the geometry of the riser can be more fully appreciated. As discussed with reference to FIG. 1, the left hand 30 of an archer grips the midsection 49 of the handgrip. The handgrip has first and second ends 50 and 51. The first end 50 curves upward and integrates with the upper section 12. The first end 50 preferably has a depression 43 for receiving the inner surface of the archer's thumb 34. Just above the first end 50, the arrow shelf 36 is formed in the upper section 12 by the recess 48. The second end 52 is integrated with one end 52 of the connecting section 18, the other end 53 of which is integrated with the lower section 14. The handgrip's midsection 49 is preferably contoured to match the anatomy of the hand 30. The fingers of the hand 30 are wrapped around the top 56 and front (not shown) surfaces of the handgrip's midsection. The palm of the hand 30 contacts the rear surface 58 of the handgrip's midsection.

The bow riser 10 is preferably formed of a single and continuous material. For example, lightweight alloys including such metals as aluminum and magnesium could be used. Composite materials including nonmetallic elements such as graphite and boron could also be used. Still further, the bow riser could be formed of solid wood or a wood laminate. Preferably, the bow riser is rigid, i.e., stiff, so that the riser does not bend or twist when subjected to the forces produced when drawing, aiming, shooting arrows. The bow limbs 22 and 24 should be elastically flexible so that they bend when an arrow is drawn. The bow riser 10 could be manufactured using an injection mold, or a solid material could be machined to the shape described previously herein and shown in the drawings.

The bow riser previously described herein and shown in the drawings is intended to be used by a right-handed archer. When positioned for shooting arrows, the archer's left arm is extended straight forward and his left hand grasps the handgrip as shown in FIG. 1. The archer views his target from the left side of the riser. A bow riser formed in accordance with the present invention for a left-handed archer is formed as the mirror image of the bow riser shown in the figures and previously described herein. The handgrip 16 and connecting section 18 would extend from the right side of the riser, and the recess 48 and arrow shelf 36 would be formed on the right side of the riser as well. The left-handed archer would hold the riser with his right arm extended straight forward and his right hand grasping the handgrip 16. The archer would view his target past the right side of the riser.

Without departing from the spirit and scope of the present invention, the riser could be formed somewhat differently from that discussed previously herein in conjunction with the drawings. For example, the structure for integrating the handgrip with the upper and lower sections 12 and 14 of the riser could be different. In one alternative embodiment, the end 51 of the handgrip could be free from the other sections of the riser. A curved member extending from the upper section 12 to the lower section 14, without interfering with the handgrip, would form a connecting section. The connecting section could extend directly from the end 50 of the handgrip, rather than connecting to the opposite ends of the handgrip; the connecting section would curve somewhat to the left side of the riser so as not to interfere with the thumb of the hand grasping the handgrip. Alternatively, the connecting section could extend in a forward protruding arc from the front surface of the upper section 12 just above the handgrip to the lower section 14. As another example, the connecting section could be formed as a rightwardly protruding arc that integrates with the right side of the upper section 12 just above the handgrip and with the lower section 14. Essentially, the connecting section is necessary to integrate the upper and lower sections.

In another alternative embodiment, the handgrip 16 could be adjustably fixed to the upper section 12 so that the angle $\theta$ at which the handgrip is oriented can be adjusted. An archer could then set the handgrip 16 at an angle $\theta$ that provides the archer with sufficient forearm/bowstring clearance and that is comfortable to the archer. The handgrip could be made adjustable by forming the riser with the handgrip end 51 free from the riser. The upper and lower sections of the riser would be integrated with a connection section, as described for the previously dicussed alternative embodiment. The integrated end 50 with the upper section would be adjustably fixed to the upper section, such that the angle $\theta$ could be modified.

The bow riser of the present invention could be used to form various forms of archery bows that are vertically held when positioned for shooting. For example, a compound bow could be formed by securing bow limbs of a form used in compound bows to the far ends of the upper and lower sections of the riser. Such bow limbs include eccentric pulleys at the far ends of the limbs. Further, the bow riser design of the present invention could be used to form simple bows of either the longbow or recurve types.

While the preferred embodiment of the invention has been illustrated and described, it should be understood that variations will be apparent to those skilled in the art. For example, a rubberized material could be added to the surface of the handgrip 16 so as to provide a more secure grip for the archer. Further, while the drawings show the handgrip in a vertical plane that is orthogonal to the plane of the bow, the handgrip could be angled somewhat rearward or forward. Accordingly, the invention is not to be limited to the specific embodiments illustrated and described, and the true scope and spirit of the invention are to be determined by reference to the following claims.

The embodiments of the invention in which an exclusive property or privilege is claimed are defined as follows:

1. A bow riser for use in an archery bow intended to be held substantially vertically, the archery bow including upper and lower bow limbs extending longitudinally in opposite directions from the bow riser, and a bowstring strung between the far ends of the upper and lower bow limbs, wherein the bow riser, the upper and lower bow limbs, and the bowstring generally from a bow plane, the bow riser comprising:

(a) an upper section;

(b) a lower section; and (c) a handgrip positioned between said upper section and said lower section and oriented at a non-zero angle less than 180° away from one side of said bow plane, and wherein said handgrip includes a midsection having an inner end, an outer end, and a central axis, said inner handgrip end curving upwardly towards said upper section and having a thumb surface comprising a depression for receiving a thumb of an archer, said central axis extending through said depression, whereby a hand of an archer grasps said handgrip by wrapping the fingers and palm around said handgrip midsection and by wrapping the thumb around said thumb surface, so that the thumb is to the side of the fingers and palm and the longitudinal torque on the bow riser is focused at the juncture between the archer's thumb and forefinger.

2. The bow riser claimed in claim 1, wherein said handgrip midsection is generally colinear with a central axis, said central axis lying in a second plane, said second plane being substantially orthogonal to said bow plane and substantially vertical when the archery bow is held for shooting.

3. The bow riser claimed in claim 2, wherein said non-zero angle is measured upwardly from said one side of said bow plane to said central axis, said non-zero angle having a value between 20° and 100°.

4. The bow riser claimed in claim 1, further comprising arrow rest means formed with said upper section on said one side of said bow plane for supporting the shaft of an arrow positioned for shooting, such that the arrow shaft is transverse to said upper section when positioned for shooting.

5. The bow riser claimed in claim 4, wherein a recess is formed in said upper section on said one side of said bow plane, such that said recess allows an archer to view a target while sighting along the shaft of an arrow positioned for shooting.

6. The bow riser claimed in claim 5, wherein said arrow rest means includes a platform, which is substantially horizontal when the archery bow is held substantially vertically, formed by said recess.

7. The bow riser claimed in claim 1, wherein said handgrip is connected to said lower section by a connecting section having first and second ends, said first connecting section end being integrated with said outer handgrip end, and said second connecting section end being integrated with said lower section.

8. A bow riser for use in an archery bow, the archery bow including upper and lower bow limbs extending longitudinally in opposite directions from the bow riser, and a bowstring strung between the far ends of the upper and lower bow limbs, wherein the bow riser, the upper and lower bow limbs, and the bowstring generally from a bow plane, the bow riser comprising:

(a) an upper section;

(b) an arrow rest means formed with said upper section on one side of said bow plane for supporting the shaft of an arrow positioned for shooting, such that the arrow shaft is transverse to said upper section;

(c) a lower section; and (d) a handgrip positioned between said upper section and said lower section, and oriented at a non-zero angle less than 180° away form said one side of said bow plane, and wherein said handgrip includes a midsection having an inner end, an outer end, and a central axis, said inner handgrip end curving upwardly towards said upper section and having a thumb surface comprising a depression for receiving a thumb of an archer, said central axis extending through said depression, whereby a hand of an archer grasps said handgrip by wrapping the fingers and palm around said handgrip midsection and the thumb around thumb surface, so that the thumb is to the side of the fingers and palm and the longitudinal torque on the bow riser is focused at the juncture between the archer's thumb and forefinger.

9. The bow riser claimed in claim 8, wherein the bow riser is generally colinear with a longitudinal axis that lies in said bow plane, and further wherein said handgrip midsection is generally colinear with a central axis lying in a second plane, said second plane being substantially orthogonal to said bow plane and substantially parallel to said longitudinal axis.

10. The bow riser claimed in claim 9, wherein said non-zero angle is measured upwardly from said one side of said bow plane to said central axis, and has a value between 20° and 100°.

11. The bow riser claimed in claim 8, wherein a recess is formed in said upper section on said one side of said bow plane, such that said recess allows an archer to view a target while sighting along the shaft of an arrow position for shooting.

12. The bow riser claimed in claim 11, wherein said arrow rest means includes a platform which is substantially orthogonal to said longitudinal axis, formed by said recess.

13. The bow riser claimed in claim 8, wherein said handgrip is connected to said lower section by a connecting section including first and second ends, said first connecting section end being integrated with said outer handgrip end, and said second connecting section end being integrated with said lower section.

14. A bow riser for use in an archery bow designed to be held substantially vertically, the archery bow including upper and lower bow limbs extending longitudinally in opposite directions from the bow riser, and a bowstring strung between the far ends of the upper and lower bow limbs, wherein the bow riser, the upper and lower bow limbs, and the bowstring generally form a bow plane, the bow riser comprising:

(a) an upper section;

(b) arrow rest means formed with said upper section on one side of said bow plane for supporting the shaft of an arrow positioned for shooting, such that the arrow shaft is transverse to said upper section;

(c) a lower section; and (d) a handgrip positioned between said upper section and said lower section, said handgrip oriented at a non-zero angle away from said one side of said bow plane, and wherein said handgrip includes a midsection having an inner end, an outer end, and a central axis, said inner handgrip end curving upwardly towards said upper section and having a thumb surface comprising a depression for receiving a thumb of an archer, said central axis extending through said depression, whereby a hand of an archer grasps said handgrip by wrapping the fingers and palm around said handgrip midsection and the thumb around said thumb surface, so that the thumb is to the side of the fingers and palm and the longitudinal torque on the bow riser is focused at the juncture between the archer's thumb and forefinger, wherein said handgrip midsection is colinear with a central axis lying in a second plane, said second plane being substantially orthogonal to said bow plane and substantially vertical when the archery bow is held for shooting, and further wherein said non-zero angle has a value between 20° and 100° measured upwardly from said one side of said bow plane to said central axis.

15. A bow riser for forming the midsection of an archery bow, the bow riser comprising:

(a) an upper section having an outer end and an inner end defining a longitudinal axis therebetween, wherein a recess is formed in a side of said upper section that is generally parallel to said longitudinal axis, said recess extending along a substantial portion of the length of said upper section and extending the width of said upper section side, such that an arrow positioned for shooting extends through said recess;

(b) a handgrip having first and second ends, said first handgrip end integrated with said upper section inner end, said handgrip angled away from said upper section side at an angle measuring between 80° and 160° with respect to said upper section side;

(c) a connecting section having first and second ends, said first connecting section end integrated with said second handgrip end; and (d) a lower section having an outer end and an inner end, and extending generally colinearly with said longitudinal axis, said lower section inner end being integrated with said second connecting section end.

16. An archery bow intended to be held generally vertically, the archery bow comprising:

(a) an upper section that generally defines a longitudinal axis between the ends thereof;

(b) a lower section that is generally colinear with said longitudinal axis;

(c) arrow rest means formed with a side of said upper section for supporting the shaft of an arrow positioned for shooting, such that the arrow shaft is transverse to said upper section when positioned for shooting; and (d) a handgrip integrated between said upper section and said lower section, said handgrip being angled away from a side of said lower section which corresponds to said upper section side at an angle measuring between 20° and 100° with respect to said lower section side, and wherein said handgrip includes a midsection having an inner end, an outer end, and a central axis, said inner handgrip end curving upwardly towards said upper section and having a thumb surface comprising a depression for receiving a thumb of an archer, said central axis extending through said depression, whereby a hand of an archer grasps said handgrip by wrapping the fingers and palm around said handgrip midsection and the thumb around said thumb surface, so that the thumb is to the side of the fingers and palm and the longitudinal torque on the bow riser is focused at the juncture between the archer's thumb and forefinger.

17. A bow riser for use in an archery bow intended to be held substantially vertically, the archery bow including upper and lower bow limbs extending longitudinally in opposite directions from the bow riser, and a bowstring strung between the far ends of the upper and lower bow limbs, wherein the bow riser, the upper and lower bow limbs, and the bowstring generally form a bow plane, the bow riser comprising:

(a) an upper section;

(b) a lower section;

(c) a handgrip, including first and second handgrip ends, positioned between said upper section and said lower section and oriented at a non-zero angle less than 180° away from one side of said bow plane, said first handgrip end being integrated with said upper section; and (d) a connecting section including first and second connecting ends, said first connecting end being integrated with said second handgrip end, and said second connecting end being integrated with said lower section.

18. A bow riser for use in an archery bow, the archery bow including upper and lower bow limbs extending longitudinally in opposite directions from the bow riser, and a bowstring strung between the far ends of the upper and lower bow limbs, wherein the bow riser, the upper and lower bow limbs, and the bowstring generally form a bow plane, the bow riser comprising:

(a) an upper section;

(b) an arrow rest means formed with said upper section on one side of said bow plane for supporting the shaft of an arrow positioned for shooting, such that the arrow shaft is transverse to said upper section;

(c) a handgrip, including first and second handgrip ends, positioned between said upper section and said lower section and oriented at a non-zero angle less than 180° away from one side of said bow plane, said first handgrip end being integrated with said upper section; and (d) a connecting section including first and second connecting ends, said first connecting end being integrated with said second handgrip end, and said second connecting end being integrated with said lower section.

* * * * *

UNITED STATES PATENT AND TRADEMARK OFFICE

CERTIFICATE OF CORRECTION

PATENT NO. : 5,119,796

DATED : June 9, 1992

INVENTOR(S) : Michael L. Dehlbom

It is certified that error appears in the above-identified patent and that said Letters Patent is hereby corrected as shown below:

| COLUMN | LINE | |
|---|---|---|
| 4 | 31 & 32 | "θ ," should read --θ,-- |
| 5 | 34 | after "aiming", insert --and-- |
| 6 | 24 | "dicussed" should read --discussed-- |
| 6 | 60 | "from" should read --form-- |
| 7 | 50 | "from" should read --form-- |
| 8 | 22 | "position" should read --positioned-- |

Signed and Sealed this

Sixteenth Day of November, 1993

Bruce Lehman

*Attest:*

BRUCE LEHMAN

*Attesting Officer*

*Commissioner of Patents and Trademarks*